United States Patent [19]

Ryder et al.

[11] 3,962,808

[45] June 15, 1976

[54] CHECKLIST DEVICE

[75] Inventors: Francis E. Ryder, Barrington; Theodore H. Mueller, Cary, both of Ill.

[73] Assignee: Ryder International Corporation, Barrington, Ill.

[22] Filed: Dec. 26, 1974

[21] Appl. No.: 536,304

[52] U.S. Cl. ..... 40/104.02; 116/134; 40/64 R

[51] Int. Cl.[2] ..... G09F 11/06

[58] Field of Search ..... 40/104.02, 102, 61, 40/64 R, 67, 19.5, 63 R, 65; 116/131, 134; 35/32, 24 R, 24 A, 24 B

[56] References Cited

UNITED STATES PATENTS

| | | | |
|---|---|---|---|
| 1,659,691 | 2/1928 | Kingman | 116/134 |
| 1,683,358 | 9/1928 | Kingman | 116/134 |
| 1,990,020 | 2/1935 | Blackwood | 40/65 |
| 3,162,174 | 12/1964 | Whyte | 35/24 AX |
| 3,345,766 | 10/1967 | Timlin | 40/64 X |
| 3,485,204 | 12/1969 | Christman | 40/65 X |
| 3,564,731 | 2/1971 | Weller | 35/24 B |

*Primary Examiner*—John H. Wolff
*Attorney, Agent, or Firm*—Olson, Trexler, Wolters, Bushnell & Fosse, Ltd.

[57] ABSTRACT

The embodiment of the invention disclosed herein is directed to a checklist device for providing an indication of tasks to be performed and tasks already performed. The checklist device includes a housing having a first receptacle therein for receiving an indicia or information bearing sheet. A second receptacle is formed in the housing and provides for the storage of drawing or other indicia-bearing sheets to be interchanged with the indicia-bearing sheet in the first receptacle. A windowed panel is secured to the housing and provides a plurality of transparent, discrete viewing areas. The indicia on the indicia-bearing sheet within the first receptacle are in registry with the transparent windows, and a plurality of groups of toggles are secured to the window panel with one group of toggles positioned in relation to one or more of the viewing areas. Each of the toggles has two positions, one position for covering selected indicia on the indicia-bearing sheet while in registry with the transparent window and another position for uncovering the selected indicia.

10 Claims, 11 Drawing Figures

CHECKLIST DEVICE

BACKGROUND OF THE INVENTION

This invention relates generally to a checklist device, and more particularly to a device with gives a visual indication of tasks to be performed and tasks already performed, the invention also relates to a new and novel toggle assembly for use in a checklist device.

Heretofore, many visual reminder devices have been provided for the purpose of reminding persons to perform certain tasks or to perform tasks in a particular sequence or order. An example of one said device can be found in Application Ser. No. 347,797, filed Apr. 4, 1973 now abandoned in favor of Ser. No. 507,042 filed on September 18, 1974. Another device of this type commonly used is a checklist device for large commercial aircraft which enables the pilot and/or co-pilot to go through a sequence of operation to ready the airplane for a takeoff or for shut-down. While many other industries need or could use this type of device, the varied requirements of each has necessitated special construction for each use. The present invention provides a single design that can be adapted to a customer's particular requirements.

For example, a machine shop or plastic molding company may incorporate a multitude of different kinds of machine tools each of which has its own independent set-up procedure. A checklist or data sheet for the particular machine being set up for a particular job is generally prepared, which is used by the machinist or operator for repeat jobs. These set-up sheets or data sheets are often mutilated or destroyed or lost because of the oily and oftentime confused environment in which the machines are used. Another problem with set-up sheets or data sheets for machines is that each time the operator is going to set-up a different machine, he may be required to return the set-up sheet for the previous job worked on and obtain a different set-up sheet for the next job. Also, it is often advantageous for machine shops of this nature to have a set of blue prints relative to the job being performed, so that machinists can refer to these, in checking the dimension of the articles being machined. The present invention provides for storage of a number of such sheets as well as blue prints in a convenient and reliable manner.

Another industry which utilizes reminder devices of one form or another is the shipping or trucking industry. Here dispatchers are required to keep track of a plurality of different items to be loaded or unloaded onto a plurality of different trucks to be delivered to different destinations. This requires the dispatcher to have a checklist to keep track of the multitude of different tasks and the multitude of different trucks being loaded. At present, many trucking docks only have loose sheets of paper secured to a clipboard or the like. Because of the open outdoor character of shipping docks, many times these sheets become lost or misplaced.

Still another industry which requires checklist devices is that of the general manufacturing and processing industries. These industries generally utilize a flow-chart type of checklist which is formed of a large pinboard secured to a wall. A multitude of squares or rectangular areas of formed on the pinboard with tasks to be performed secured to the pinboard in a certain sequence and possibly of a certain color. Tasks already performed are then secured to the pinboard in a different area and possibly of a different color. The disadvantage of the large pinboard type of flow-chart is that it is too large to take from place to place for meetings or other conferences required for keeping track of the various steps in the actual production line. Another disadvantage of the pinboard type of flow-chart is that it cannot be easily changed from one manufacturing process to another, thereby requiring a different pinboard flow-chart for each manufacturing process, in the case of a multitude of manufacturing processes being carried on by the same manufacturer.

In addition to the specific types of industries mentioned above, there are a multitude of other industries which utilize means for keeping track of tasks to be performed and tasks already performed. In each of these industries, there are particular problems encountered when utilizing checklist devices which are presently available, the most common one of which is that they do not provide a simple and efficient means for keeping track of a multitude of different operations each of which has its own multitude or plurality of different tasks to be performed.

SUMMARY OF THE INVENTION

Accordingly, it is an object of this invention to provide a simple and efficient checklist device which enables a person or persons to keep track of a multitude of different operations, each of which has a multitude of different tasks to be performed.

Another object of this invention is to provide a new and improved checklist device which provides protection for indicia-bearing sheet material to prevent the sheet material from becoming frayed and dirty.

Still another object of this invention is to provide a new and improved toggle mechanism that can be employed in the construction of checklist devices of varying size and shape, and which do not require special designs and manufacturing techniques for each use.

Still another object of this invention is to provide a new and novel checklist device for keeping track of a plurality of different tasks to be performed and tasks already performed and which can be readily portable from place to place.

Briefly, the checklist device of this invention includes a housing having spaced apart front and rear walls formed of panel material and side and bottom walls formed of extruded channel members such as extruded aluminum. The channel member provides channels which receive intermediate and rear wall panels and a window panel, the latter of which forms the front wall. Said window panel has a plurality of transparent windows or viewing areas formed thereon. An indicia-bearing sheet is inserted into a receptacle formed between the intermediate wall panel and the window panel with the indicia on the sheet coming into registry with the transparent windows of the window panel. A plurality of groups of toggle elements are secured to the window panel, each group being in registry with an associated one of the plurality of transparent windows. For example, there may be 10 toggle elements per group extending across the transparent window and six or more vertically disposed transparent windows formed on the window panel. Each of the toggles within the groups of toggles has two positions, one position for covering the selected indicia on the indicia-bearing sheet in registry with the transparent window and another position for uncovering the selected indicia.

Each of the groups of toggles is constructed in a novel arrangement. A common channel is utilized for receiving a plurality of axially aligned bearing block members. The bearing block members have interlocking tab means formed on one side thereof and engageable with the channel. The tab means are so arranged to provide a spacing between each of the bearing block means to receive a cam portion of the toggle members. An integrally formed biasing and mounting arm extends from the cam portion and is held in position within the bearing block elements on each side thereof. The resilient arm includes an enlarged terminating end portion to fit into a correspondingly sized socket or recess formed within the bearing block element substantially centrally thereof. The passage through the bearing block element leading up to the central portion is of a size greater than the size of the socket. This enables the arm member to flex within the bearing block as the tab is flipped from one position to another position and the cam portion thereof engages a cam portion engaging surface formed by the interlocking tab elements between the bearing block elements. Accordingly, since the bearing block elements are removable, groups of toggles of varying length can be assembled, with respect to specially designed block assemblies for each application.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENTS

Figure 1:
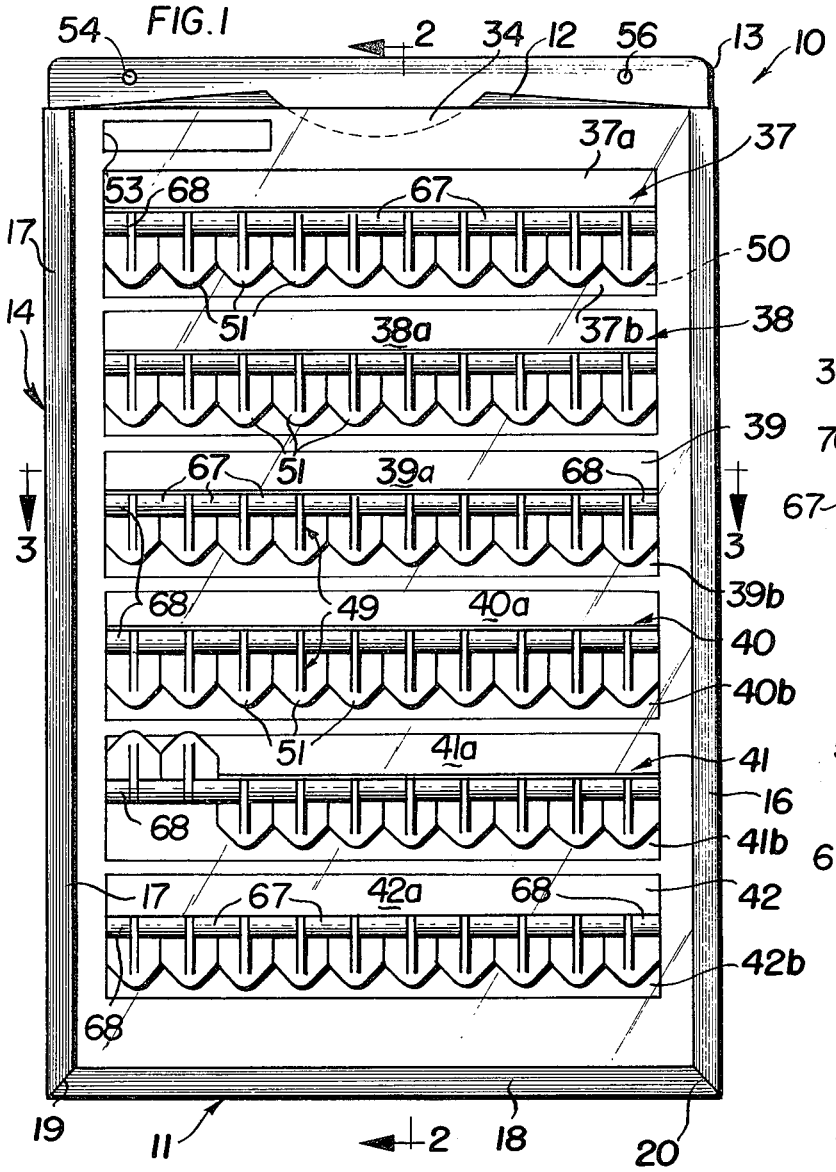
FIG. 1 is a front view of a checklist device constructed in accordance with the principles of this invention.
Figure 3:
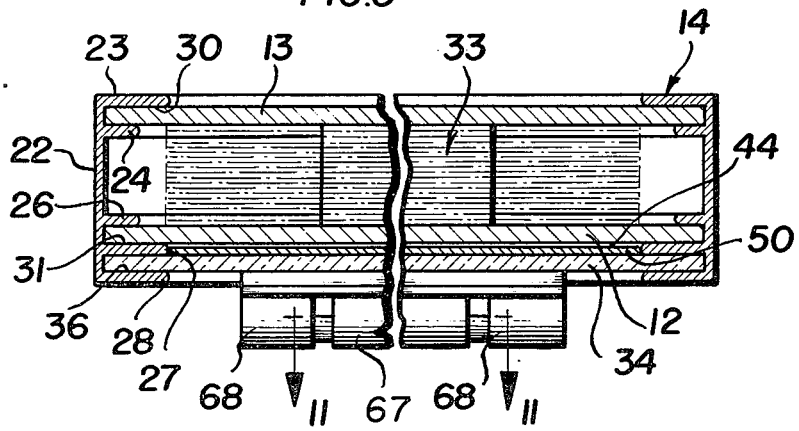
FIG. 3 is a fragmentary sectional view taken along the line 3—3 of FIG. 1 showing the channels formed in an extruded member forming the side and bottom wall portions of the checklist device of FIG. 1.

Referring now to FIG. 1 there is seen a checklist device constructed in accordance with the principles of this invention and designated generally by reference numeral 10. The checklist device 10 includes a housing 11, provided by spaced apart front and rear wall panel elements 12 and 13, respectively. An extruded channel member 14 provides the side walls 16 and 17 and a bottom wall 18. The channel member preferably is of unitary construction and cut on a miter at corners 19 and 20 and folded 90° at these points. The corners may be riveted, welded or otherwise more permanently fastened together if desired. The configuration of the channel member 14 is best illustrated in FIG. 3 which shows the channel member as including a web portion 22 with a plurality of spaced apart flange portions 23, 24, 26, 27 and 28. The flange portions 23 and 24 provide a first channel 30 which receives one marginal edge of the rear panel 13 at one side and the other marginal edge of the panel 13 at the other side. The flanges 26 and 27 provide a second channel 31 which receives one marginal edge of the front panel 12 at one side and the other marginal edge of the front panel 12 at the other side. The space between flanges 24 and 26 provides a receptacle designated generally by reference numeral 33.

Most advantageously, the housing 10 includes an additional window panel 34. The window panel 34 is held in position in the housing by sliding the marginal side edges thereof into a channel 36 formed between the flanges 27 and 28 of the extruded member 14, as best seen in FIG. 3. The window panel 34 overlies the panel 12 in spaced relation to provide an additional reception space 44 or an indicia-bearing sheet 50.

The window panel 34 has a plurality of transparent windows or viewing areas 37, 38, 39, 40, 41 and 42 of substantially uniform configuration and positioned at vertically spaced apart locations along the window panel, as best seen in FIG. 1. While rectangular transparent windows of substantially uniform configuration are illustrated in the embodiment disclosed herein, it will be understood that other configuration may be utilized. For example, the transparent windows may be arranged in columns as well as rows or may be of different configurations and areas.

The flange portion 31 of the extruded member 14, of FIG. 3, forms a space between the front wall panel 12 and the window panel 34 which serves as the receptacle 44 for sheet 50. The receptacle 44 is relatively thin and extends the entire height or length of the housing 11, i.e. from the bottom wall portion 18 to the upper terminating ends of the side wall portions 16 and 17.

Figure 4:
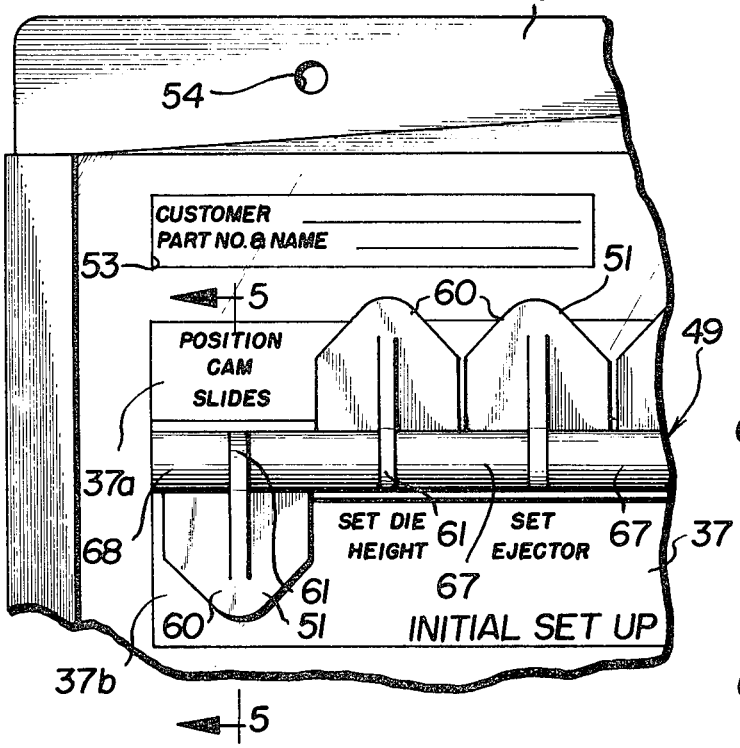
FIG. 4 is an enlarged fragmentary view of the upper left hand corner of the device of FIG. 1, as viewed, illustrating the relation of the toggle member to the viewing areas and the indicia or information on the data sheet disposed beneath said viewing areas.

In accordance with the principles of this invention, and indicia-bearing sheet 50 has indicia formed thereon and is positioned to be in registry with the transparent windows or viewing areas 37 – 42 when inserted into the receptacle 44. The indicia-bearing sheet 50 may have legends corresponding to particular tasks to be performed for various reasons, such as setting up a machine tool, loading or unloading particular trucks, or a manufacturing process flow-chart, as shown in FIG. 4. Each of the tasks to be performed are identified by a legend or the like at a discrete location within the respective transparent windows 37 – 42. Toggle assemblies 49 are positioned adjacent the viewing areas, and each of said discrete location has a toggle element 51 provided. For example, the toggles 51 may be in one position for covering selected indicia on the sheet 50 and in another position for uncovering the selected indicia. In the illustrated embodiment, each task to be performed is duplicated in the top and bottom portons 37*a* and 37*b*, respectively, 38*a*, 38*b*, 39*a*, 39*b*, 40*a*, 40*b*, 41*a*, 41*b*, and 42*a*, 42*b*. Therefore, when the toggles 51 are in one position, for example the up position, it may indicate that the task is to be performed. On the other hand, when the toggles 51 are in the down position, it may indicate that the tasks have already been performed.

As shown in FIG. 4, a transparent window area 53 may be provided at the upper left-hand corner of the window panel 34 and provide means for viewing code indicia such as job sheet number or the like on the indicia-bearing sheet 50. To facilitate storing or hanging of the checklist device 10 apertures 54 and 56 are formed at the upper portion of the rear panel 13.

Figure 5:
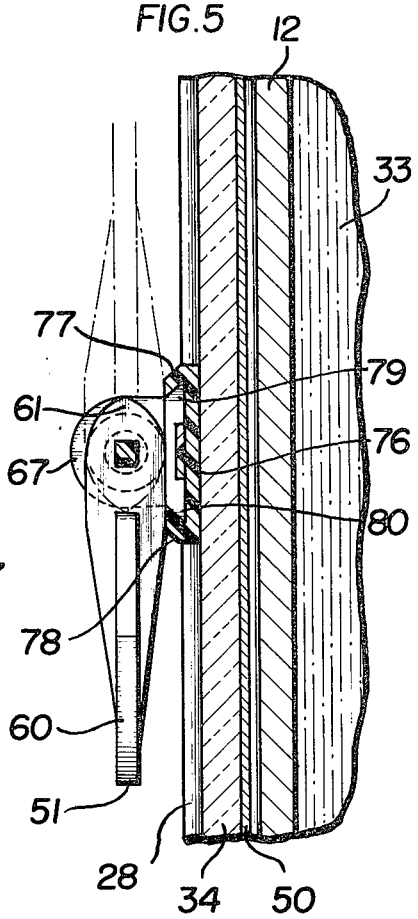
FIG. 5 illustrates the toggle member utilized on the checklist device of FIG. 1 in one position shown in solid line and in another position shown in phantom lines.
Figure 6:
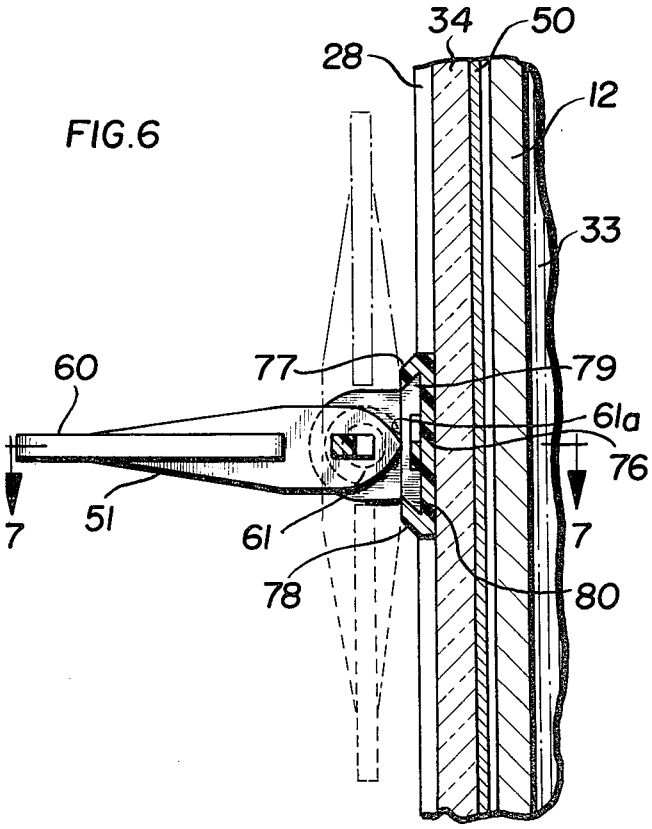
FIG. 6 is a view similar to FIG. 5 showing an extended condition for the toggle as it passes over the center of its cam surface from one side to the other side.
Figure 7:
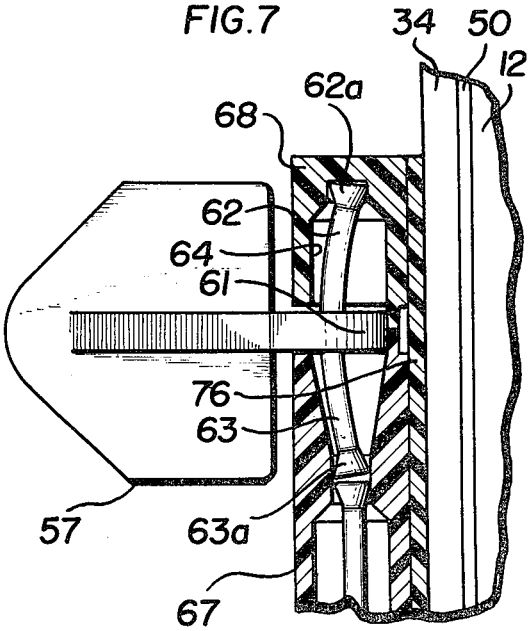
FIG. 7 is a sectional view taken along line 7—7 of FIG. 6 showing the flexure of the biasing and mounting arms forming integral with the cam element of the toggle of FIGS. 4 – 7.

For a better understanding of the operation of the toggle members of the illustrated embodiment of this invention, reference is now made to FIGS. 4, 5 and 6 which illustrate the details of construction and operation. Each of the toggle members 51 includes a hand-operated tab portion 60 having a cam portion 61 formed integral therewith. Extending in opposite directions from the cam portion 61 are flexible arm elements 62 and 63 preferably formed integral with the cam portion 51. However, it will be understood that a flexible element may be inserted through an aperture formed in the cam portion. The flexible arm members 62 and 63 are inserted into recesses or channels 64 and 66, respectively, of bearing blocks 67 and 68, respectively. The flexible arm members 62 and 63 have head portions 62*a* and 63*a* to be inserted into sockets 70 and 71, respectively. The sockets 70 and 71 are reduced-diameter portions of the channels 64 and 66.

Figure 2:
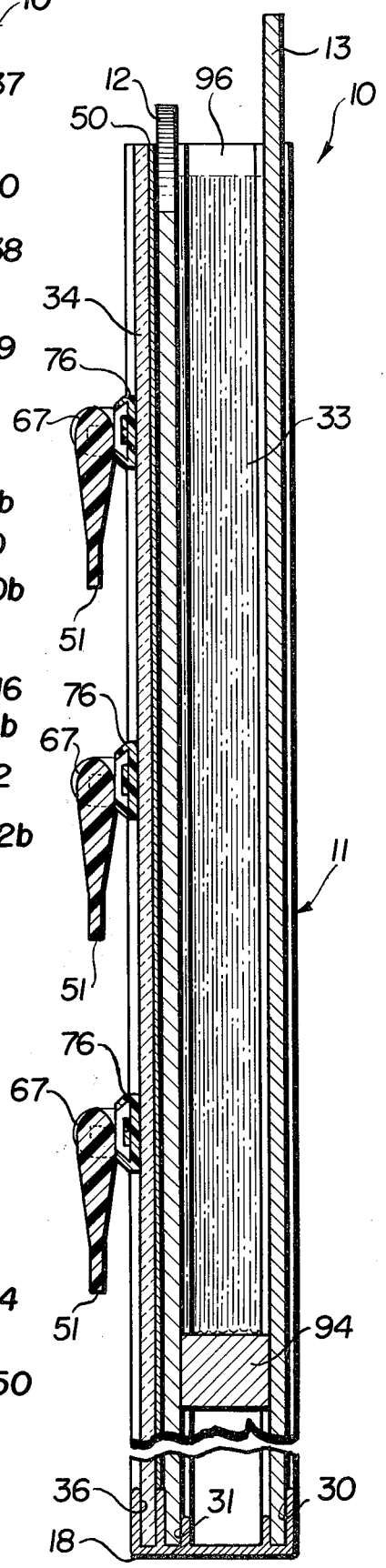
FIG. 2 is a side sectional view of the checklist device of FIG. 1 taken along the line 2—2.

When the toggle 51 is in the position shown in FIG. 2, the flexible arm members 62 and 63 are substantially straight. As the toggle member is moved from one position to the other position, cam portion 61 engages a cam portion engaging surface 61*a*. This causes the arm portions 62 and 63 to flex away from the cam portion engaging surface 61*a*, as best seen in FIG. 6. As the cam portion 61 passes over the center of its apex, the toggle will move to the other position in a snap action as a result of the bias provided by the resilient arm 62 and 63.

Most advantageously, the toggle elements 51 are provided in the form of assemblies 49 and are secured across each of the transparent windows 37 – 42 to divide the windows into separate viewing areas 37*a*, 37*b* – 42*a*, 42*b*. Preferably, the transparent windows have one portion, either 37*a* or 37*b*, of greater height than the other portion to expose to view identification indicia other than the tasks to be performed.

The toggle assemblies 49 are made up of a plurality of assembled bearing block elements 67 and toggle member 51. The configuration thereof is best viewed in FIG. 10. In this regard, there is provided a channel shaped base member 76 having turned-in edge portions 77 and 78. The edge portions 77 and 78 provide recesses to receive flanges or beveled edges 79 and 80, respectively formed as part of the bearing blocks 67. A plurality of the individual bearing blocks 67 can then be inserted into the channel 76 to provide for a group of toggle members 51, as illustrated. Each bearing block 67 has a mounting recess 64 formed in one end, and a corresponding mounting recess 66 formed in the opposite end, for reception of the resilient mounting arms 62 and 63.

Figure 11:
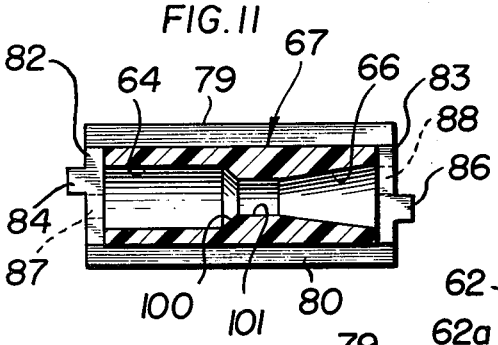
FIG. 11 is a longitudinal sectional view taken through one of the bearing blocks used in the construction of the toggle assembly of this invention.
Figure 10:
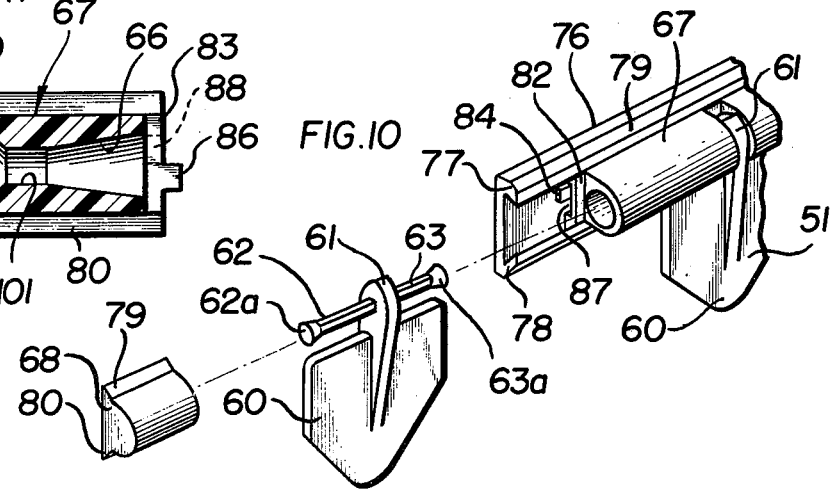
FIG. 10 is an enlarged exploded perspective of the toggle arrangement in accordance with the principles of this invention.

The individual bearing blocks 67 are of identical shape and are adapted for interfitting engagement. In this regard, each block is provided with opposed end flange portions 82 and 83, as shown in FIGS. 10 and 11. The end portion 82 is provided with a tab 84 and an adjacent slot 87. Correspondingly, the end portion 83 has a tab 86 and slot 88 similarly positioned. Therefore, interlocking of the tabs and the slots occurs as the bearing blocks 67 are assembled along the channel 76. Terminating or end bearing blocks 68 are provided to close off the grouping of blocks 67 and toggle elements 51, which blocks 68 have but a single recess formed therein.

Figure 8:
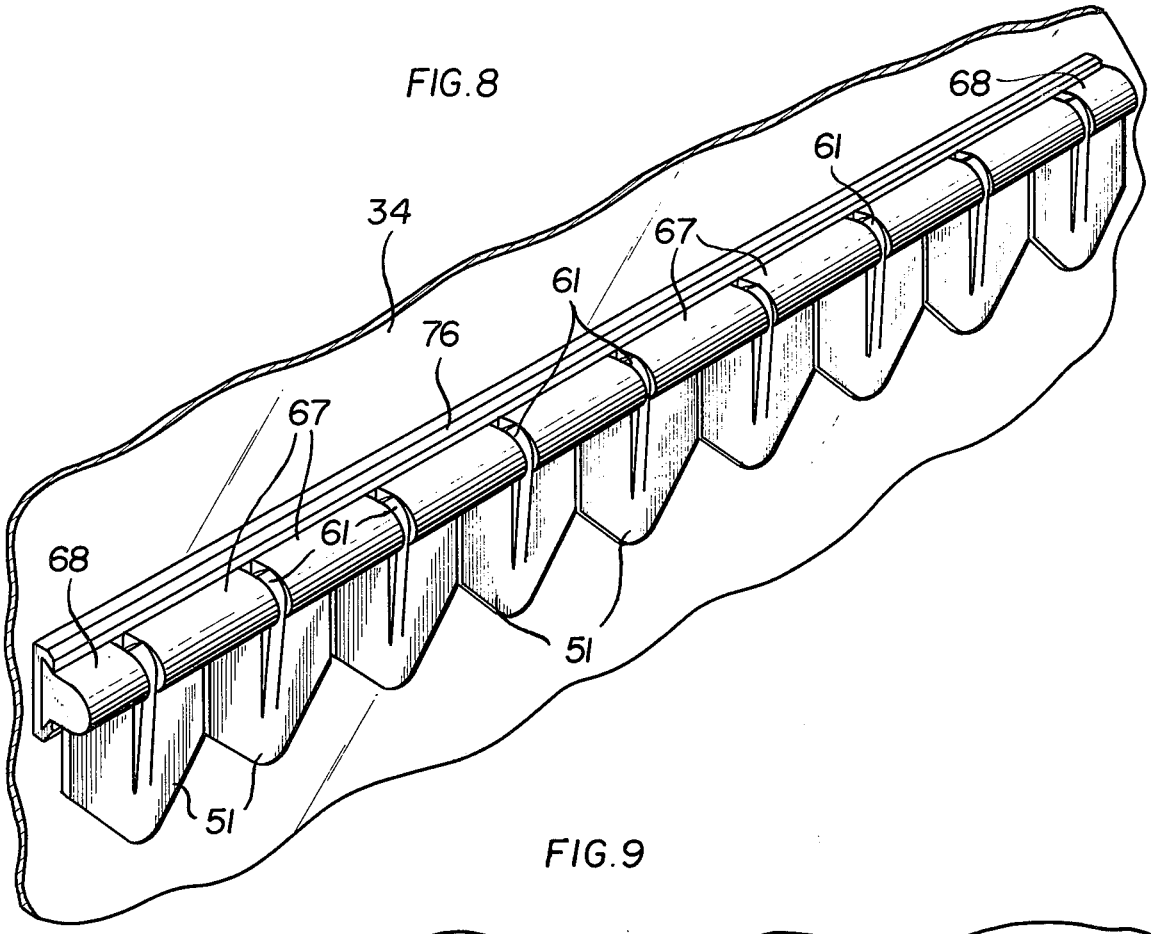
FIG. 8 is an assembled view of a group of toggles constructed in accordance with this invention and shown in a straight or flat condition.
Figure 9:
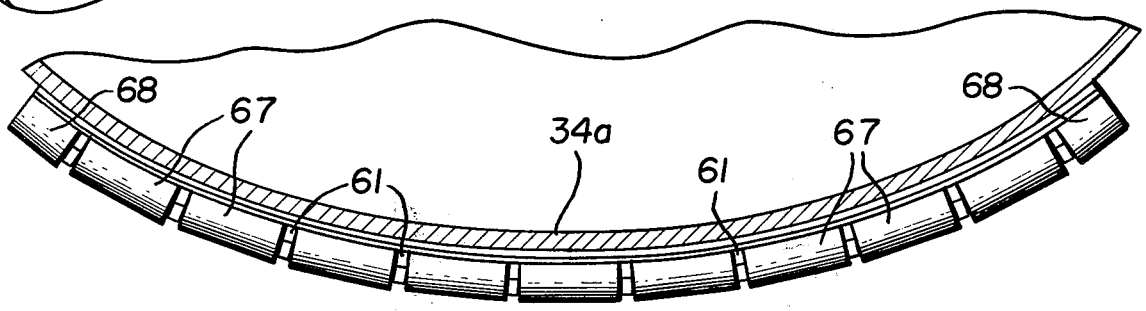
FIG. 9 is an assembled view of a group of toggles constructed in accordance with this invention and shown in a round or curved condition.

FIG. 8 illustrates the toggle assembly in a flat, straight condition for mounting to flat surfaces such as the window plate 34 shown in FIGS. 1 and 2. However, the channel member 76, together with the individually coupled-together bearing block elements, provides an articulate flexible arrangement that can be mounted to curved or arcuate surfaces, as illustrated in FIG. 9.

To facilitate supporting of folded sheets within the receptacle portion 33, a support block or member 94 may be positioned within the receptacle 33 between the upper opened end portion 96 thereof and the bottom wall portion 18 thereof. The relative location of the support 94 will vary according to the size of folded sheet material to be inserted in the receptacle portion 33.

What has been described is a simple and efficient checklist device and a novel toggle assembly used in conjunction therewith. While a single specific embodiment of the invention has been disclosed herein, it will be understood that variations and modifications may be effected without departing from the spirit and scope of the novel concepts as set forth in the following claims.

The invention is claimed as follows:

1. A checklist device for providing an indication of tasks to be performed and tasks already completed, comprising in combination: a housing having spaced apart first and second walls, and side and bottom walls for holding said first and second walls in a fixed spaced apart relationship relative to one another, said first wall being provided by a window panel secured relative to said side and bottom walls and having a plurality of transparent discrete viewing areas provided thereon, said window panel being positioned over said second wall, but spaced therefrom to provide a receptacle for an indicia bearing sheet having indicia bearing areas formed thereon to be positioned in registry with said viewing areas, and a plurality of toggle assemblies secured to said window panel with one said assembly positioned in relation to each said viewing area, each said toggle assembly capable of being adjusted as to the number of toggle elements employed and including a plurality of toggle elements and support means for said toggle elements, which elements each include a tab portion for manual engagement and movement thereof between a first and second position, and oppositely extending mounting members for mounting said toggle elements to said support means, said support means including a channel shaped base member, a plurality of separate elongate bearing block elements, means mounting said bearing block element to said channel shaped base member in juxtopposed end-to-end aligned relationship, said bearing block elements being comprised of first and second types of elements, said first type comprising one or more identically shaped elements, each of which includes a bearing recess at the opposite ends thereof such that the recesses of adjacent bearing block elements rotatably receive the oppositely extending mounting members of an associated toggle element, thereby adapting said toggle element for rotative movement whereby the tab portion thereof can be moved between a first and second position, said second type of elements being disposed at the respective ends of said channel shaped base member, each said second types of element having but a single bearing recess for rotatably receiving a mounting member of an associated toggle element, and serving to define the distal ends of said assembly.

2. In a checklist device for providing an indication of tasks to be performed and tasks already performed, as set forth in claim 1, wherein said side and bottom wall include a plurality of spaced apart channels, one said channel receiving said window panel and said second wall being in the form of a panel member disposed in another of said channels, there being provided a third wall in the form of a panel disposed in spaced relation to said second wall thereby providing an additional receptacle area.

3. In a checklist device for producing an indication of tasks to be performed and of tasks already performed as set forth in claim 2, wherein said additional receptacle includes support means therein for supporting articles of a length which is less than the overall height of said first receptacle, whereby folded sheet material can be inserted into said additional receptacle and easily retrieved from an open top of said housing.

4. In the checklist device for providing an visual indication of tasks to be performed and of tasks already performed, as set forth in claim 1, wherein said base member is formed of a channel, said bearing block means including a plurality of discrete bearing block elements slidably engaged with said channel, said bearing block elements having recesses at opposite ends to receive said resilient arm members of adjacent toggle elements, and two of said bearing block elements being opened at one end only and forming the end bearing block elements thereby providing an assembly of toggle elements to be secured to said transparent windows.

5. In the checklist device for providing a visual indication of tasks to be performed and tasks already performed, as set forth in claim 1, wherein said bearing block elements provide axially extending interlocking tab means at the opposite ends thereof to engage correspondingly formed axially extending interlocking tab means on adjacent bearing block elements.

6. In the checklist device for providing a visual indication of tasks to be performed and tasks already performed, as set forth in claim 5, wherein said bearing block elements having flat surface portions adjacent said recesses, said outwardly directed tab means being formed in said flat surface portions for providing a space between said bearing block elements to receive said cam portion of said toggle element, and said flat surface portions further forming said cam portion engaging means.

7. In the checklist device for providing a visual indication of tasks to be performed and tasks already performed, as set forth in claim 5, wherein said tab means of each of said bearing block means are displaced on opposite sides of a plane passing through said central axis and perpendicular to said channel, whereby said bearing block elements can be rotated 180° in position relative to one another with said tab means of one bearing block element being interlocked when in either position with said tab means of another bearing block element.

8. A toggle assembly capable of being adjusted as to the number of toggle elements employed, for use in a checklise device, or the like, said assembly including a plurality of toggle elements and support means for said toggle elements, each said toggle element including a tab portion for manual engagement, and oppositely extending mounting means for mounting said toggle element to said support means for movement between a first and second position, the improvement wherein said support means includes a channel shaped base member, a plurality of separate elongate bearing block elements, means slidably mounting said bearing block elements to said channel shaped base member in opposed, aligned relationship, said plurality of bearing block elements being comprised of first and second types of elements, said first type comprising one or more identically shaped elements, each of which includes a bearing recess at opposite ends thereof, the bearing recesses of adjacent bearing block elements rotatably receiving the oppositely extending mounting members of an associated toggle element, thereby adapting the tab portion of said toggle element for movement between said first and second positions, and said second type of bearing block elements being disposed at the respective ends of said channel shaped base member and each said second type of element having but a single bearing recess for rotatably receiving a mounting member of an associated toggle element, and serving to define the distal ends of said toggle assembly.

9. A toggle assembly for use in a checklist device as set forth in claim 8, wherein each said bearing block elements includes axially extending interlocking tab means at the opposite axial ends thereof to engage correspondingly formed axially extending interlocking tab means on adjacent ones of said bearing block elements.

10. A toggle assembly for use in a checklist device as set forth in claim 9, wherein said bearing block elements have flat surface portions intermediate said bearing means, which bearing means are spaced to provide a channel for said toggle elements, which elements include a cam portion with said flat surface portions providing cam portion engaging means, whereby said toggle may be moved with a snap action.

* * * * *

UNITED STATES PATENT AND TRADEMARK OFFICE

CERTIFICATE OF CORRECTION

PATENT NO. : 3,962,808

DATED : June 15, 1976

INVENTOR(S) : Francis E. Ryder and Theodore H. Mueller

It is certified that error appears in the above-identified patent and that said Letters Patent are hereby corrected as shown below:

Col. 1, line 6, "with" should be --which--
Col. 3, line 61, "forming" should be --formed--
Col. 5, line 12, "portons" should be --portions--
Col. 7, line 32, "producing" should be --providing--

Signed and Sealed this

Twelfth Day of October 1976

[SEAL]

*Attest:*

RUTH C. MASON
*Attesting Officer*

C. MARSHALL DANN
*Commissioner of Patents and Trademarks*